US009422812B2

(12) United States Patent
Paros et al.

(10) Patent No.: US 9,422,812 B2
(45) Date of Patent: Aug. 23, 2016

(54) CUTTING TOOL MOUNTING ASSEMBLY WITH ELASTOMERIC COATED BUSHING

(71) Applicant: Kennametal Inc., Latrobe, PA (US)

(72) Inventors: Nicholas J. Paros, Johnstown, PA (US); Chad A. Swope, Bedford, PA (US); Donald E. Keller, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 29 days.

(21) Appl. No.: 14/513,547

(22) Filed: Oct. 14, 2014

(65) Prior Publication Data

US 2016/0102550 A1 Apr. 14, 2016

(51) Int. Cl.
*E21C 35/183* (2006.01)
*E21C 35/18* (2006.01)

(52) U.S. Cl.
CPC ..... *E21C 35/18* (2013.01); *E21C 35/183* (2013.01); *E21C 2035/1803* (2013.01)

(58) Field of Classification Search
CPC ..... E21C 2035/1803; E21C 35/197; B28D 1/186
See application file for complete search history.

(56) References Cited

U.S. PATENT DOCUMENTS 5,302,005 A 4/1994 O'Neill
5,730,502 A * 3/1998 Montgomery, Jr. .. E21C 35/197 299/104
6,099,081 A * 8/2000 Warren ..... E21C 35/187 299/104
7,234,782 B2 6/2007 Stehney
9,028,008 B1 * 5/2015 Bookhamer ..... E21C 35/197 299/104
2009/0091177 A1 * 4/2009 Moore ..... E21C 35/197 299/102
2010/0052406 A1 * 3/2010 Beach ..... E21C 35/197 299/104
2013/0169023 A1 * 7/2013 Monyak ..... E21C 35/197 299/104

FOREIGN PATENT DOCUMENTS

WO 2006108200 A1 10/2006
WO WO 2014040349 A1 * 3/2014 ..... E21C 35/197

* cited by examiner

*Primary Examiner* — David Bagnell
*Assistant Examiner* — Michael Goodwin
(74) *Attorney, Agent, or Firm* — Larry R. Meenan

(57) ABSTRACT

A cutting tool mounting assembly adapted for receiving a cutting tool includes a base having a bottom portion and a front portion that defines a receptacle having an inner wall and a bushing configured for receipt in the receptacle of the base. The bushing includes: a forward face defining an aperture for receiving the cutting tool; a shoulder generally opposite the forward face, the shoulder configured for cooperating with the front portion of the base; and a shank portion extending rearward from the shoulder, the shank portion having an outer surface configured for cooperating with the inner wall of the receptacle. A first elastomeric layer is positioned between the shoulder of the bushing and the front portion of the base and a second elastomeric layer is positioned between the outer surface of the shank portion and the inner wall of the receptacle.

7 Claims, 4 Drawing Sheets

CUTTING TOOL MOUNTING ASSEMBLY WITH ELASTOMERIC COATED BUSHING

BACKGROUND OF THE INVENTION

The invention pertains generally to a cutting tool mounting assembly that is useful in association with machines for impinging a substrate or earth strata such as, for example, asphaltic roadway material, coal deposits, mineral formations and the like. More particularly, the invention pertains to a cutting tool mounting assembly as well as the individual components of such assemblies.

One typically uses such assemblies in conjunction with a rotatable drum or driven member. The driven member rotates in such a fashion to drive the rotatable cutting bit or tool into earth strata to disintegrate the same into smaller pieces including fine particulates, i.e., cutting debris. The cutting bit or cutting tool and the base or support block are each subjected to considerable stresses during mining operations, road milling operations or other like operations that can lead to wear and/or failure of one or more of the cutting tool assembly components. One source of wear occurs as a result of the mounting between the cutting bit or cutting tool and the base or support block and the contact therebetween. Accordingly, there is a desire to mount the cutting bit or cutting tool in the base or support block so as to reduce stress between the components in order to maximize the useful life of all the components of the cutting tool assembly.

One solution to minimize such stress and/or wear is to provide a bushing between the cutting bit or cutting tool and the base or support block. Typically, the bushings are press fit into the base or support block which after a long time of operation they can begin to rust together and become very difficult to remove. An alternative to the bushing arrangement is to use a sleeve which is a slip fit into the base or support block and held in with an external retainer. These are easier to remove but cause the base or support block to wear quicker.

Thus, it would be highly desirable to provide an improved cutting tool mounting assembly that overcomes disadvantages and shortcomings of heretofore known such assemblies. It would also be highly desirable to provide an improved cutting tool mounting assembly having a bushing arrangement that is easier to remove while still providing the desired protection to the base or support block in comparison to heretofore known such arrangements.

SUMMARY OF THE INVENTION

In accordance with an aspect of the invention, a cutting tool mounting assembly adapted for attachment to a surface of a rotatable driving member of a cutting tool machine and adapted for receiving a cutting tool includes a base having a bottom portion for attachment to the surface of the rotatable driving member and a front portion that defines a receptacle having an inner wall and a bushing configured for receipt in the receptacle of the base. The bushing includes: a forward face defining an aperture for receiving the cutting tool; a shoulder generally opposite the forward face, the shoulder configured for cooperating with the front portion of the base; and a shank portion extending rearward from the shoulder, the shank portion having an outer surface configured for cooperating with the inner wall of the receptacle. A first elastomeric layer is positioned between the shoulder of the bushing and the front portion of the base and a second elastomeric layer is positioned between the outer surface of the shank portion and the inner wall of the receptacle.

In accordance with another aspect of the invention, a cutting tool mounting assembly adapted for attachment to a surface of a rotatable driving member of a cutting tool machine and adapted for receiving a cutting tool includes a base having a bottom portion for attachment to the surface of the rotatable driving member and a front portion that defines a receptacle having an inner wall and a bushing configured for receipt in the receptacle of the base. The bushing includes: a forward face defining an aperture for receiving the cutting tool; a shoulder generally opposite the forward face, the shoulder configured for cooperating with the front portion of the base; and a shank portion extending rearward from the shoulder, the shank portion having an outer surface configured for cooperating with the inner wall of the receptacle. Also included is a first elastomeric layer formed on at least a portion of the shoulder of the bushing and a second elastomeric layer formed on at least a portion the outer surface of the shank portion.

In accordance with another aspect of the invention, a cutting tool mounting assembly adapted for attachment to a surface of a rotatable driving member of a cutting tool machine and adapted for receiving a cutting tool includes a base having a bottom portion for attachment to the surface of the rotatable driving member and a front portion that defines a receptacle having an inner wall. An elastomeric coated bushing is configured for receipt in the receptacle of the base. The elastomeric coated bushing includes: a forward face defining an aperture for receiving the cutting tool; a shoulder generally opposite the forward face, the shoulder configured for cooperating with the front portion of the base; and a shank portion extending rearward from the shoulder, the shank portion having an outer surface configured for cooperating with the inner wall of the receptacle.

These and other aspects of the present invention will be more fully understood following a review of this specification and drawings.

DETAILED DESCRIPTION

Figure 1:
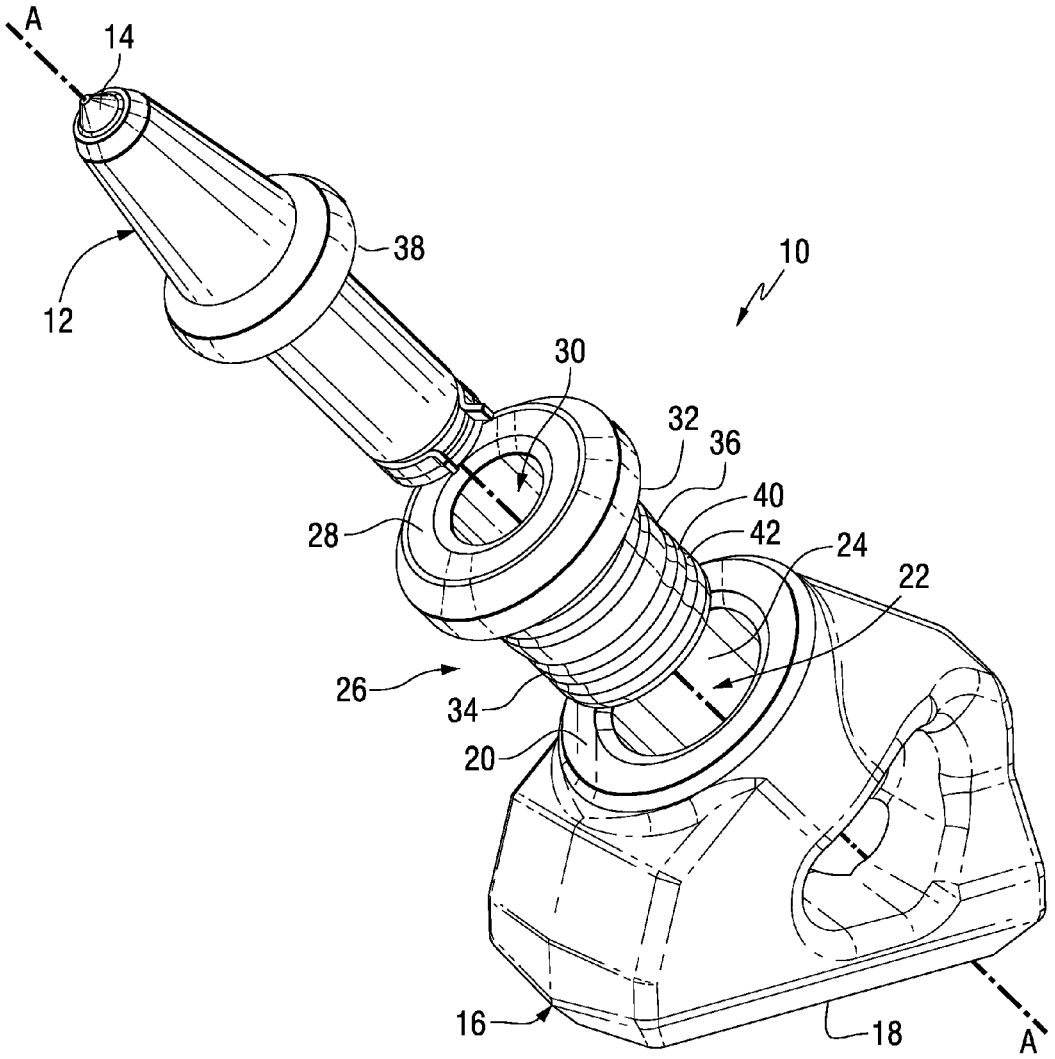
FIG. 1 is an exploded isometric view of a cutting tool mounting assembly, in accordance with an aspect of the invention.
Figure 2:
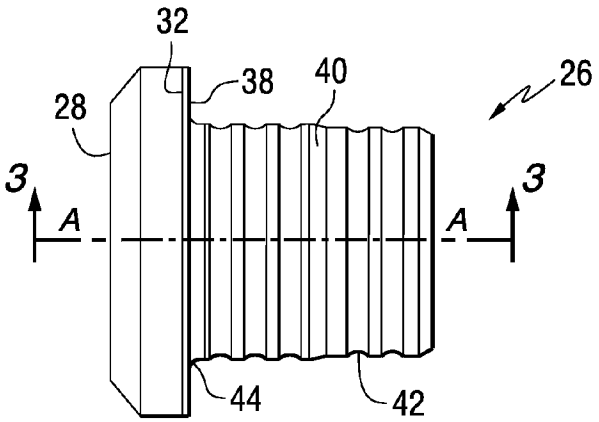
FIG. 2 is a side view of a bushing shown in FIG. 1, in accordance with an aspect of the invention.

The following description is for purposes of illustrating various aspects of the invention only and not for purposes of limiting the scope of the invention.

Referring to the Figures, there is illustrated a cutting tool assembly or cutting tool mounting assembly, generally designated as reference number 10, in accordance with various aspects of the invention. As will be apparent following a description of the invention herein, when referring generally to a "cutting tool mounting assembly" adapted for attachment to a surface of a rotatable driving member of a cutting tool machine the invention generally includes a base configured for attachment to the surface of the rotatable driving member, bushing configured for receipt in the base and a cutting tool configured for receipt in the bushing. For simplification of description of the invention herein, these aspects of the invention may be generally referred to as an "assembly."

It will be appreciated that the invention has application to various kinds of cutting tools useful in various kinds of cutting operations. Exemplary operations include, without limitation, road planing (or milling), coal mining, concrete cutting, and other kinds of cutting operations wherein a cutting tool with a hard cutting member impinges against a substrate (e.g., earth strata, pavement, asphaltic highway material, concrete, minerals and the like) breaking the substrate into pieces of a variety of sizes including larger-size pieces or chunks and smaller-sized pieces including dust-like particles. In addition, it will be appreciated that the cutting tool mounting assembly 10 of the invention, and components thereof, may be manufactured in various sizes and dimensions depending upon the desired application of the assembly 10.

Referring to FIGS. 1-5, there is illustrated in detail the assembly 10 and various components of the invention. The assembly 10 is adapted for attachment to a surface of a rotatable driving member of a cutting machine (not shown) such as, for example, a mining machine. The assembly 10 is attached or connected to the rotatable driving member such as, for example, a rotating drum by methods well known in the art such as, for example, welding. The assembly 10 is configured for mounting or receiving a cutting tool 12 with a hard cutting member 14 for impinging against a substrate, e.g., earth strata, pavement, asphaltic highway material, concrete, minerals and the like as is well known in the art.

The assembly 10 includes a base 16. The base 16 includes a bottom surface or bottom portion 18 and a front portion 20 that defines a receptacle 22. The receptacle 22 includes an inner surface or inner wall 24.

The assembly 10 also includes a bushing 26 configured to be received in the receptacle 22 of the base 16. Typically, the bushing 26 is press fit into the receptacle 22 of the base 16. In one aspect, the bushing 26 is configured to be releasably received in the receptacle 22 so that the bushing 26 receives most of the impact and wear from the cutting tool 12 during operation and therefore reduces or minimizes wear on the base 16. Then bushing 26 can be removed and replaced as needed.

The bushing 26 includes a forward face 28 that defines an aperture 30 for receiving the cutting tool 12. In addition, the bushing 26 includes a shoulder 32 generally opposite the forward face 28. The shoulder 32 is configured for cooperating with the front portion 20 of the base 16. The bushing 26 also includes a shank portion 34 extending generally rearward from the shoulder 32. In one aspect, the shank portion 34 has an outer surface 36 configured for cooperating with the inner wall 24 of the receptacle 22 when the bushing 26 is inserted in the receptacle 22. In another aspect, the shank portion 34 is generally cylindrical. However, the shank portion 34 can be other shapes such as, for example, triangular or quadrilateral as well.

The assembly 10 can have a central longitudinal axis A-A that passes centrally through the cutting tool 12, aperture 30 of the bushing 26 and receptacle 22 of the base 16.

In accordance with an aspect of the invention, the bushing 26 can generally be an elastomeric coated bushing 26 having a first elastomeric layer 38 positioned between the shoulder 32 of the bushing 26 and the front portion 20 of the base 16 and a second elastomeric layer 40 positioned between the outer surface 36 of the shank portion 34 and the inner wall 24 of the receptacle 22 of the base 16.

In one aspect, elastomeric layers 38 and 40 can be constructed from, for example, polyisoprene, a polyisoprene blend, butyl rubber, acryl rubber, polyurethane, flurorubber, polysulfide rubber, ethylene-propylene rubber (EPR and EPDM), Hypalon, chlorinated polyethylene, ethylene-vinyl acetate rubber, epichlorohydrin rubber, chloroprene rubber, silicone, or other heavily damped elastomer.

In another aspect, the first elastomeric layer 38 is formed on the shoulder 32 of the bushing 2. In yet another aspect, the second elastomeric layer 40 is formed on the outer surface 36 of the shank portion 34. The elastomeric layers 38, 40 may be attached to the respective surfaces of the bushing 26 by, for example, chemical bonding, mechanical fixtures or tabs, glues or adhesives, or any suitable type of thermally activated shrink tubing.

Figure 4:
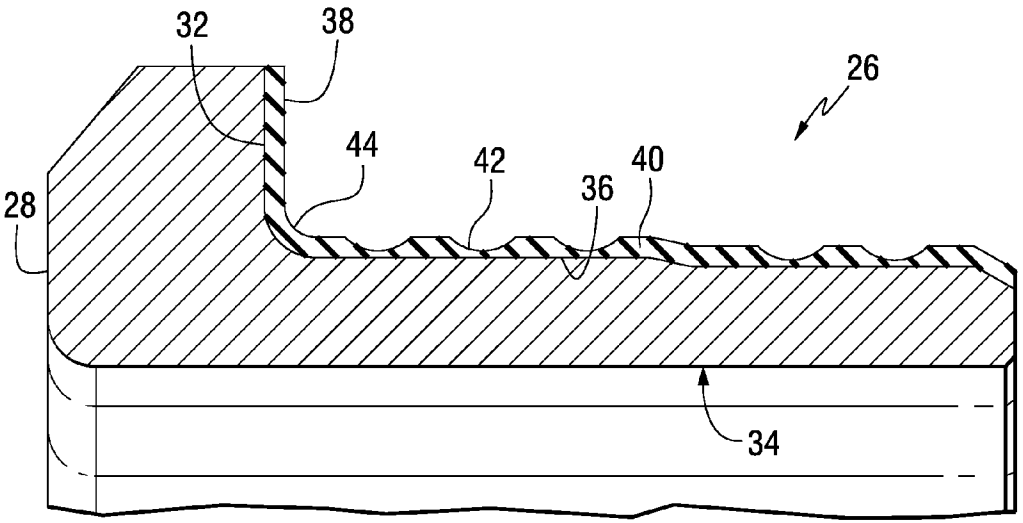
FIG. 4 is an enlarged view of a portion of FIG. 3, in accordance with another aspect of the invention.
Figure 3:
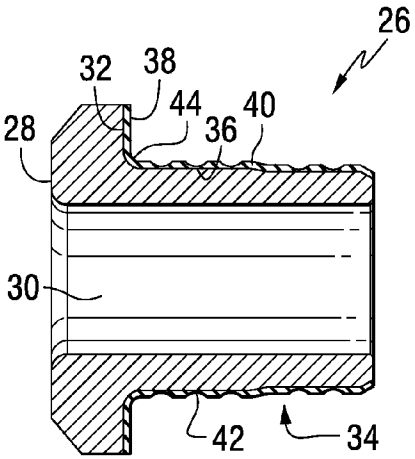
FIG. 3 is a sectional view along line 3-3 of FIG. 2, in accordance with an aspect of the invention.
Figure 5:
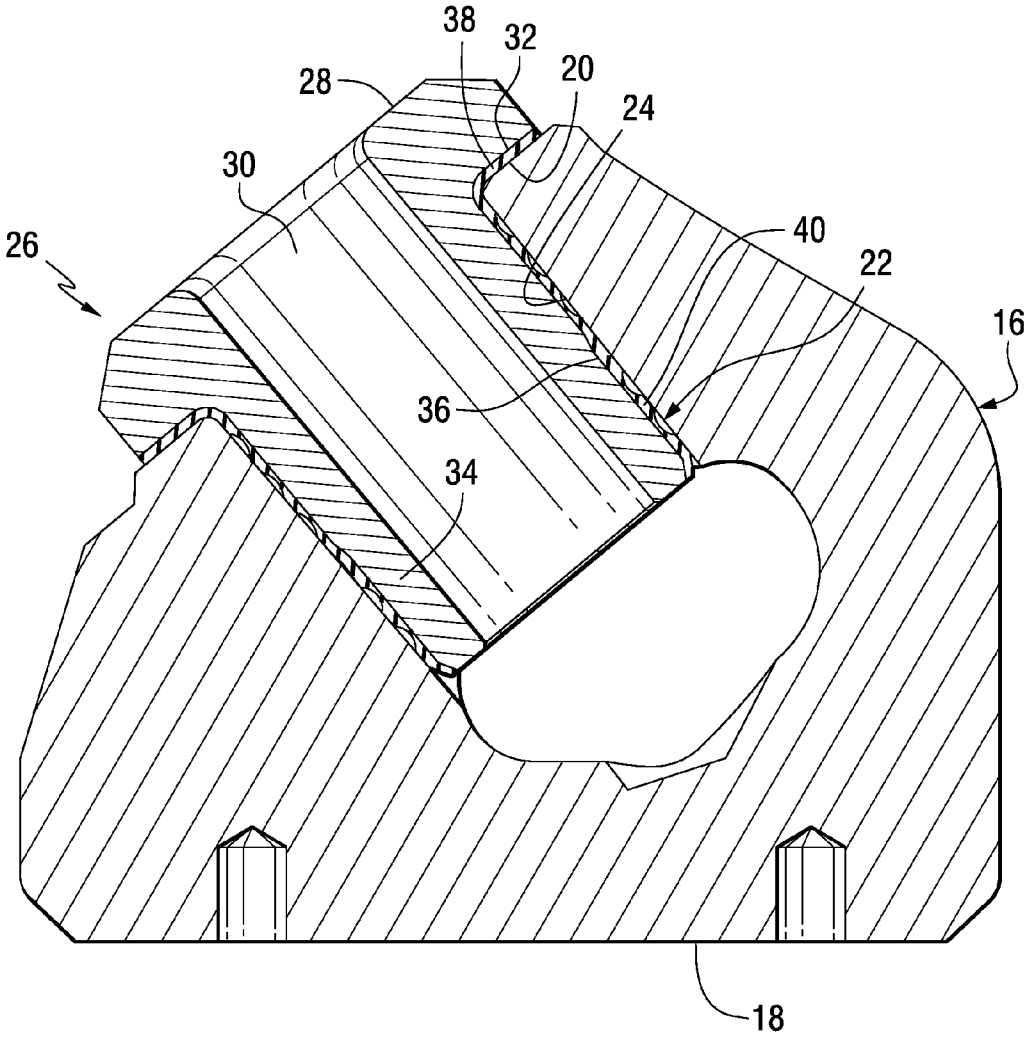
FIG. 5 is a sectional view of the bushing as received in a base of the cutting tool mounting assembly, in accordance with an aspect of the invention.

In another aspect of the invention, the second elastomeric layer 40 can have a variable thickness. In one aspect, the second elastomeric layer 40 can be non-linear. In another aspect, as shown for example in FIG. 4, the elastomeric layer 40 has grooves with a radius and flat portions etc. that result in the layer 40 being of variable thickness. For example, as shown in FIG. 4 the elastomeric layer 40 has an outer surface 42 that is rounded, flat, wave-like etc. resulting in the layer 42 being generally non-linear. The variable thickness surface provides voids for the rubber to flow into when compressed by surface 24. The voids may be shaped with a radius, flats, in a triangular or polygon shapes in order to provide additional retention force and resistance to removal.

In another aspect, the first elastomeric layer 38 adjoins the second elastomeric layer 40 (as generally designated at 44, i.e. where the shoulder 32 meets the shank portion 34) to form a continuous elastomeric layer on the bushing 26.

Figure 6:
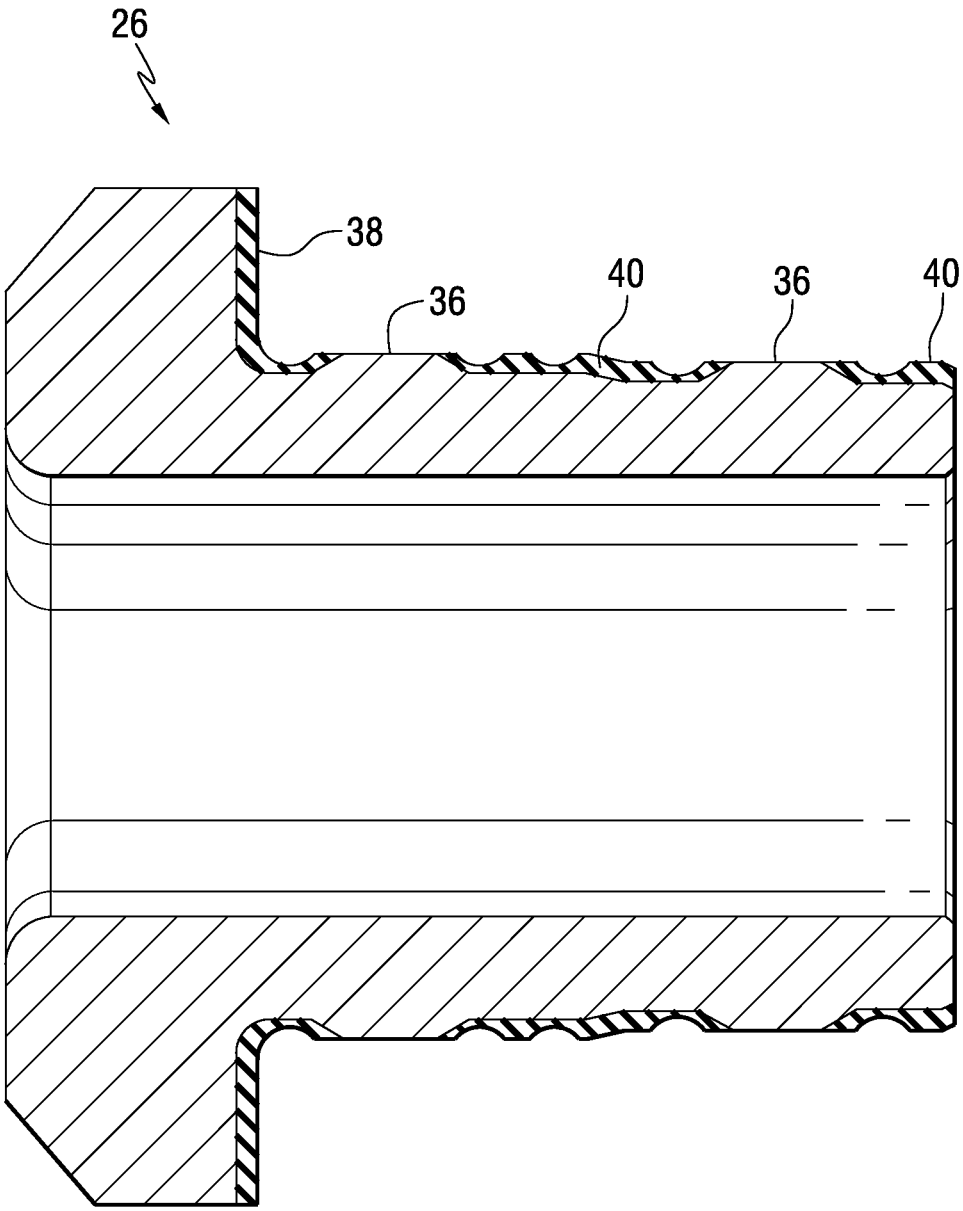
FIG. 6 is an additional bushing similar to the bushing shown in FIG. 3, in accordance with an aspect of the invention.

In another aspect, first elastomeric layer 38 can be formed on at least a portion of the shoulder 32, i.e., could be formed on all of the shoulder 32 of the bushing 26 or could be formed on less than all of the shoulder 32 of the bushing 26. In addition, second elastomeric layer 40 can be formed on at least a portion of the outer surface 36 of the shank portion 34, i.e., could be formed on all of the outer surface 36 of the shank portion 34 or could be formed on less than all of the outer surface 36 of the shank portion 34 (as illustrated, for example, in FIG. 6 where at least some of the outer surface 36 is not covered or coated with the elastomeric layer 40 which would result in the exposed portions of outer surface 36 contacting the inner wall 24 of receptacle 22 of the base 16).

It will be appreciated that the various aspects of the invention including, for example, the surfaces 36 in conjunction with the surfaces 38 and 40 has may advantages. For example, surface 36 could be a metal to metal press fit with surface 24. But, by having the metal surfaces 36 surrounded by elastomeric surfaces 38 and 40 that are also interference fit with surface 24 it will isolate surfaces 36 from exterior conditions such as air, water, chemicals, etc. and act as a barrier to prevent rust on surfaces 36. This in turn makes the bushing 26 easier to remove from the receptacle 22 of the base 16 after use.

Whereas particular aspects of this invention have been described above for purposes of illustration, it will be evident to those skilled in the art that numerous variations of the details of the present invention may be made without departing from the invention as defined in the appended claims.

What is claimed is:

1. A cutting tool mounting assembly adapted for attachment to a surface of a rotatable driving member of a cutting tool machine and adapted for receiving a cutting tool, the cutting tool mounting assembly comprising:

a base having a bottom portion for attachment to the surface of the rotatable driving member and a front portion that defines a receptacle having an inner wall;

a bushing configured for receipt in the receptacle of the base, the bushing comprising:

a forward face defining an aperture for receiving the cutting tool;

a shoulder generally opposite the forward face, the shoulder configured for cooperating with the front portion of the base; and a shank portion extending rearward from the shoulder, the shank portion having an outer surface configured for cooperating with the inner wall of the receptacle;

a first elastomeric layer positioned between the shoulder of the bushing and the front portion of the base; and a second elastomeric layer positioned between the outer surface of the shank portion and the inner wall of the receptacle, wherein the first elastomeric layer is formed on the shoulder of the bushing and the second elastomeric layer is formed on the outer surface of the shank portion and wherein the first elastomeric layer adjoins the second elastomeric layer to form a continuous elastomeric layer.

2. The cutting tool mounting assembly of claim 1, wherein the second elastomeric layer has a variable thickness.

3. The cutting tool mounting assembly of claim 1, wherein an outer surface of the second elastomeric layer is non-linear.

4. The cutting tool mounting assembly of claim 1, wherein the bushing is press fit into the receptacle of the base.

5. A cutting tool mounting assembly adapted for attachment to a surface of a rotatable driving member of a cutting tool machine and adapted for receiving a cutting tool, the cutting tool mounting assembly comprising:

a base having a bottom portion for attachment to the surface of the rotatable driving member and a front portion that defines a receptacle having an inner wall; and an elastomeric coated bushing configured for receipt in the receptacle of the base, the elastomeric coated bushing comprising:

a forward face defining an aperture for receiving the cutting tool;

a shoulder generally opposite the forward face, the shoulder configured for cooperating with the front portion of the base; and a shank portion extending rearward from the shoulder, the shank portion having an outer surface configured for cooperating with the inner wall of the receptacle, wherein the elastomeric coated bushing includes a first layer of elastomeric material formed on the shoulder of the bushing, wherein the elastomeric coated bushing includes a second layer of elastomeric material formed on the outer surface of the shank portion, and wherein the first layer of elastomeric material adjoins the second layer of elastomeric material to form a continuous elastomeric layer.

6. The cutting tool assembly of claim 5, wherein the second layer of elastomeric material has a variable thickness.

7. The cutting tool assembly of claim 5, wherein an outer surface of the second layer of elastomeric material is non-linear.

* * * * *